US005369458A

United States Patent [19]

Wernicke et al.

[11] Patent Number: 5,369,458

[45] Date of Patent: Nov. 29, 1994

[54] LIQUID STRIPPER FOR PHOTOGRAPHIC MATERIAL

[75] Inventors: Ubbo Wernicke, Rösrath-Kleineichen; Viktor Osegowitsch, Taufkirchen; Günter Röckle, Gummersbach, all of Germany

[73] Assignee: Agfa Gevaert Aktiengesellschaft, Leverkusen, Germany

[21] Appl. No.: 978,828

[22] Filed: Nov. 19, 1992

[30] Foreign Application Priority Data

Dec. 4, 1991 [DE] Germany ..... 4139949
Dec. 13, 1991 [DE] Germany ..... 4141192

[51] Int. Cl.[5] ..... G03D 3/00
[52] U.S. Cl. ..... 354/319
[58] Field of Search ..... 354/317–324

[56] References Cited

U.S. PATENT DOCUMENTS 4,875,067 10/1989 Kanzaki et al. ..... 354/322 X
4,882,246 11/1989 Ohba et al. ..... 354/320
5,059,998 10/1991 Sasaki et al. ..... 354/324
5,168,297 12/1992 Wernicke ..... 354/324

FOREIGN PATENT DOCUMENTS

0505820A2 3/1992 European Pat. Off. .
0491049A1 6/1992 European Pat. Off. .
92119919.6 4/1993 European Pat. Off. .
1530619 11/1978 United Kingdom .

*Primary Examiner*—D. Rutledge
*Attorney, Agent, or Firm*—Connolly & Hutz

[57] ABSTRACT

A device for processing photographic materials comprising at least one liquid-filled tank and liquid from the liquid-filled tank is removed from the photographic material and lead back to the same tank. The tank comprises several pairs of rollers placed one above the other above the liquid level of the tank or downstream of the tank. The rollers of each pair of rollers are parallel to one another. At least one pair of rollers is provided with a liquid supply directed to the pair of rollers to provide a system for efficient cleaning of the photographic material. The rollers have an adjustable pressure device and a specific pressure range.

9 Claims, 1 Drawing Sheet

LIQUID STRIPPER FOR PHOTOGRAPHIC MATERIAL

FIELD OF THE INVENTION

This invention relates to a device for processing photographic materials from at least one liquid-filled tank and means which remove most of the liquid from the photographic material leaving the tank and lead said liquid back to the same tank.

BACKGROUND OF THE INVENTION

In the course of the photographic process, the photographic material (films/paper) passes through a multistage process, e.g. development, washing, bleaching, washing, fixing, washing, stabilizing, drying or development, fixing, washing and drying.

So-called "wipers" were originally used to remove as much of the water adhering to the photographic material as possible before the drying process. This speeds up the drying process and saves energy which would otherwise be required for evaporating off the water adhering to the material.

These wipers are sometimes also used before and after the individual processing steps in order to reduce the amount of solutions carried over from one stage to the next. The devices used for this purpose may be, for example, rubber lips which strip the photographic material on one side or both.

Other devices are known in which the liquid adhering to the surface is blown off by compressed air. Yet another method is that of vacuum suction.

Whereas the production of a vacuum is technically relatively expensive, the simple use of compressed air has the disadvantage that the chemical solutions make contact in a finely atomized state with parts of the film where troublesome crystal residues are left after evaporation of the liquid.

Rubber lips, on the other hand, have the disadvantage that when used for prolonged periods with a material of a particular width, they undergo more wear at the edges than in the middle so that when there is a change in the format of the material the lips can no longer act uniformly over the whole width of the material. They must therefore be frequently replaced.

So-called squeezing rollers are also frequently used in photographic technology, the photographic material being passed between these rollers under pressure. The liquid adhering to the surface is thereby removed to some extent but liquids and chemicals present in the gelatine layers of the photographic material are not removed by this procedure. Such a pair of rollers is therefore not sufficiently effective.

SUMMARY OF THE INVENTION

The device according to the invention is characterized in that a) several pairs of rollers arranged one above the other are provided above the liquid level of the tank or downstream of the tank, b) the rollers of each pair are arranged parallel to one another, and c) at least one pair of rollers, preferably below the uppermost pair, is provided with a liquid supply directed to said pair of rollers.

The axes of each pair of rollers are preferably parallel to the horizontal. The rollers of at least one pair of rollers contact one another with a pressure of from 4,900 to 98,000 pascals. The above-mentioned pressure condition is preferably fulfilled by at least 50% of the pairs of rollers, in particular all the pairs.

Preferably at least one roller of at least one pair of rollers is driven; in particular, all pairs of rollers may be driven.

The surface of at least one roller of each pair is preferably made of an elastic material, preferably rubber. The other roller of the pair may be made of an elastic material but may also consist e.g. of high grade steel or a rigid plastic.

In a preferred embodiment of the device, the liquid supply is provided at the highest point below the uppermost pair of rollers. The photographic material which is passed between the rollers of each pair of rollers after leaving the tank may thus be subjected to a small quantity of a liquid, in particular water, so that a cascade washing with the least possible quantity of liquid is achieved within the smallest possible space.

A plurality of such arrangements of pairs of rollers placed one above the other may be provided and several such arrangements may be provided over a single tank. The water applied to the photographic material is carried in countercurrent to the material and may be conducted towards the material by baffle plates or guides.

BRIEF DESCRIPTION OF THE DRAWINGS

The device according to the invention is described in more detail in FIG. 1.

DETAILED DESCRIPTION OF THE INVENTION

Figure 1:
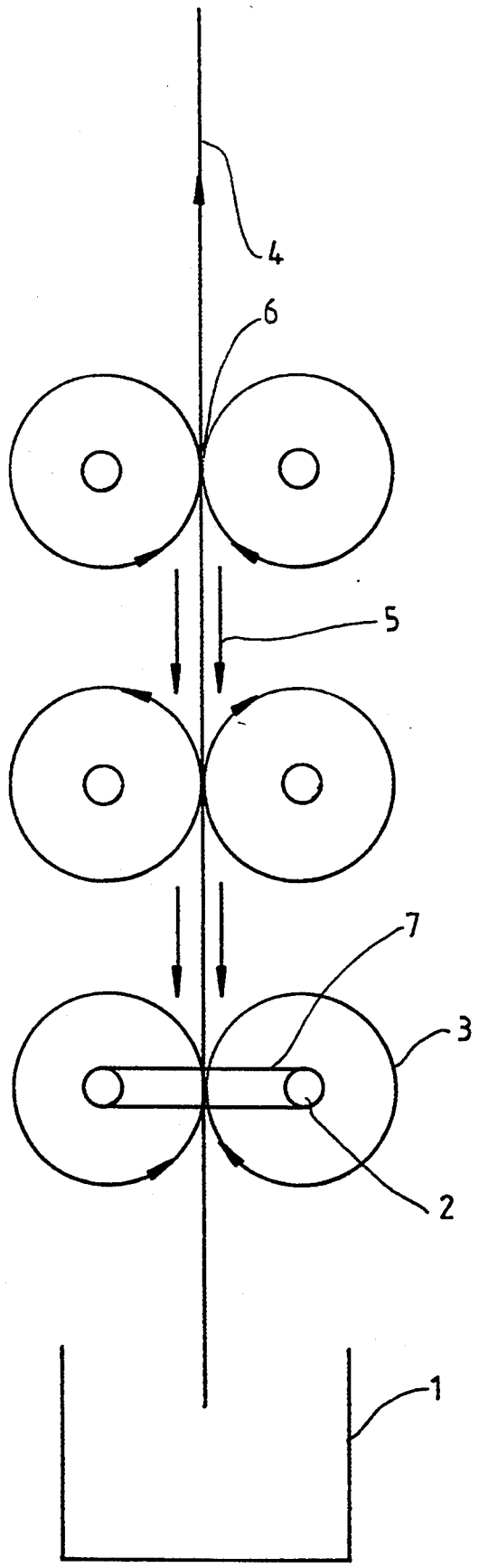
FIG. 1 shows a side view of the device according to the invention, and it also shows the directions of movement of the pairs of rollers, of the photographic material and of the liquid supplied.

FIG. 1 shows a tank (1) inside a photographic processing apparatus, for example a washing tank, whose water level is not shown. Pairs of rollers (3) are mounted one above the other on shafts (2) on a framework (not shown). One roller of each pair is provided with a drive (not shown). The reference numeral (4) indicates the photographic material moving in the direction indicated by an arrow, and (5) represents a liquid which may contain wetting agents and/or antioxidants and/or biocides supplied at point (6), in particular wash water. The wash water maybe applied to one or both sides of the photographic material and flows over the outside of one pair of rollers before reaching the next pair until it finally drops into the tank (1). Reference numeral (7) denotes a device for adjusting the pressure between the two rollers of a pair of rollers.

The number of pairs of rollers provided is preferably 2 to 20, in particular 3 to 15, and the width of the rollers is adjusted to the photographic material to be processed.

The diameter of the rollers is not critical but for reasons of space it will be advantageous to choose a diameter of from 1 to 10 cm. The two rollers of each pair of rollers may be of different diameter.

The contact pressure between the rollers of each pair may be adjusted, for example, by tension springs passing round the shafts of both rollers.

The invention further relates to a cleaning process for a photographic material which has previously been treated with a chemical solution, for example a development, bleaching, fixing or bleach-fixing bath, characterised in that the material after passing said solution passes through several successive pairs of rollers which are situated above the liquid level of the solution or downstream of the solution. The rollers of each pair of rollers are arranged parallel to one another and the material is moistened with water after passing between at least one pair of rollers. Preferably, however, the material is moistened with water after passing between each pair of rollers.

In particular, the water flowing down from one pair of rollers is used for moistening the pair of rollers immediately below it. The water used for moistening one pair of rollers may in particular be from 20 to 500 ml of water/$m^2$, preferably from 30 to 300 ml/$m^2$.

Preferably, the liquid is guided to that bath the material left just before.

EXAMPLES

EXAMPLE 1 (Comparison)

A photographic film 35 mm in width passes through a developer, a washing stage, a bleaching bath, a washing stage, a fixing bath and another washing stage and is finally dried.

The composition of the bleaching bath has the following formulation:

| | | |
|---|---|---|
| $NH_4Br$ | 140 | g/l |
| $(NH_4)$ FeEDTA | 70 | g/l |
| EDTA acid | 10 | g/l |
| pH | 6.0. | |

The residence time of the film in the bleaching bath is 4 min 20 sec and the temperature is 37.8° C. After passing through the bleaching bath the film enters a small washing tank 0.5 liters in capacity.

The material then passes through a second washing tank 5.0 liters in capacity.

Rate of feed 5 m/min.

Washing rate 200 ml/$m^2$ in washing tank 1.

No fresh water is supplied to washing tank 2.

5 $m^2$ of film had passed through the apparatus after 30 minutes. The amount of $NH_4Br$ in tank 2 was determined analytically as a measure of the amount of bleaching bath which was carried into the washing tank.

Tank 2: $NH_4Br$ 9.5 g/l

EXAMPLE 2 (According to the Invention)

The procedure was the same as in Example 1 but the wiper according to the invention shown in FIG. 1, comprising 3 driven pairs of rollers arranged one above the other and parallel to the horizontal, was mounted above the washing tank 1 at the outflow end of the material. Further, the supply of water to tank 1 was shut off and instead, 200 ml of water/$m^2$ were dripped over the upper pair of rollers.

It was only from the last pair of rollers that the water entered tank 1. The pressure with which the rollers of all three pairs of rollers made contact with one another was 9,800 pascals. The surfaces of all the rollers consisted of rubber.

To demonstrate the effectiveness of the apparatus according to the invention, the concentration of $NH_4Br$ in tank 2 was again determined.

Tank 2: $NH_4Br$ 1.3 g/l.

Result: For a given quantity of water, cleaning of the photographic material is more than 7 times as efficient as that obtained without the stripper according to the invention.

EXAMPLE 3 (Comparison)

A commercial photographic colour paper passes through a developer, a washing bath, a bleaching bath, a washing bath, a fixing bath and another washing bath and is finally dried.

| | | | |
|---|---|---|---|
| Times: | Developer | 45 sec | 35° C. |
| | Washing | 22 sec | 25° C. |
| | Bleaching bath | 45 sec | 35° C. |
| | Washing | 22 sec | 25° C. |
| | Fixing bath | 45 sec | 35° C. |
| | Washing I | 22.5 | 25° C. |
| | Washing II | 22.5 | 25° C. |
| | Washing III | 22.5 | 25° C. |

The composition of the fixing bath has the following formulation:

| | |
|---|---|
| $Na_2S_2O_3$ | 100 g/l |
| $Na_2SO_3$ | 10 g/l |

and the bath was replenished during the time of the experiment.

The contents of each tank was 5 liters. The washing rate in washing tank 1 was 120 ml/$m^2$. Washing tank II was left without supply of fresh water. Washing III received 900 ml/$m^2$.

After 100 $m^2$ of color paper 8.9 cm in width had been processed, the amount of sodium thiosulphate in washing tank II was determined analytically. This was taken as a measure of the amount of liquid carried over when the washing rate in tank I was 120 ml/$m^2$.

11.8 g $Na_2S_2O_3$/l were found in tank II.

EXAMPLE 4 (According to the Invention)

The procedure was the same as in Example 3 but in this case the stripper according to the invention comprising 4 driven pairs of rollers arranged one above the other was mounted in washing tank 1 and the water was discharged from the tank.

In addition, the supply of water to tank I was shut off and instead, 120 ml/$m^2$ of water were dripped over below upmost pair of rollers.

The pressure with which the rollers of each of 4 pairs made contact with one another was about 68,500 pascals.

The concentration of sodium thiosulphate in washing tank II was again determined (analytically).

Tank II: Sodium thiosulphate 2.9 g/l

Better cleaning of the material is obtained for a given quantity of water used for washing stage I.

We claim:

1. Device for processing photographic materials from at least one liquid-filled tank and means for substantially removing the tank liquid from the photographic material leaving the tank and leading said liquid back to the same tank, characterized in that in operation a) several pairs of rollers are arranged one above the other above the liquid level of the tank or downstream of the tank, b) the rollers of each pair of rollers are arranged parallel to one another, c) at least one pair of rollers is provided with a supply of liquid, and d) said device contains means for adjusting the pressure with which the rollers of at least one pair of rollers make contact with one another, the pressure is adjusted to 4,900 to 98,000 pascals.

2. Device according to claim 1, wherein the axes of each pair of rollers are set parallel to the horizontal.

3. Device according to claim 2, characterised in that at least 50% of the pairs of rollers fulfill the pressure of 4,900 to 98,000 pascals.

4. Device according to claim 1, characterised in that at least one roller of the at least one pair of rollers is driven.

5. Device according to claim 1, characterised in that the surface of at least one roller of each pair of rollers is made of an elastic material, therefor.

6. A process for washing a photographic material which has previously been treated with a chemical solution, characterized in that the material after passing said solution passes through several pairs of rollers arranged one above the other above the liquid level of the solution or downstream of the solution, the rollers of each pair or rollers being arranged parallel to one another and the rollers of at least one pair of rollers make contact with one another at a pressure of 4,900 to 98,000 pascals and the material being moistened with liquid after passing between at least one pair of rollers.

7. A device for the processing of photographic materials from at least one tank containing a liquid, comprising at least one liquid-filled tank, at least two pairs of rollers, said rollers having external surfaces, said rollers being arranged such that the roller external surface contacts said photographic materials after the photographic materials have been removed from contact with the liquid in the tank, said rollers in each pair being disposed parallel to each other, the rollers of at least one of said pairs of rollers making contact with one another with a pressure of 4,900 to 98,000 pascals, and a supply of liquid provided to at least one pair of rollers.

8. A device as claimed in claim 7, wherein each pair of rollers are disposed parallel to horizontal.

9. A device as claimed in claim 7, wherein at least 50% of the pairs of rollers have rollers which make contact with one another with a pressure of 4,900 to 98,000 pascals.

* * * * *